US010968001B2

(12) United States Patent
Van Der Meij

(10) Patent No.: US 10,968,001 B2
(45) Date of Patent: Apr. 6, 2021

(54) HYBRID COUNTING DEVICE AND METHOD

(71) Applicant: XIAC AUSTRALIA PTY LTD, Erskine Park (AU)

(72) Inventor: Michael Leonardus Hendricus Van Der Meij, Erskine Park (AU)

(73) Assignee: XIAC Australia Pty Ltd, Erskine Park (AU)

( * ) Notice: Subject to any disclaimer, the term of this patent is extended or adjusted under 35 U.S.C. 154(b) by 0 days.

(21) Appl. No.: 16/079,313

(22) PCT Filed: Dec. 24, 2017

(86) PCT No.: PCT/IB2017/058392
§ 371 (c)(1),
(2) Date: Aug. 23, 2018

(87) PCT Pub. No.: WO2019/122991
PCT Pub. Date: Jun. 27, 2019

(65) Prior Publication Data

US 2020/0307847 A1 Oct. 1, 2020

(51) Int. Cl.
*B65B 57/20* (2006.01)
*B65B 5/10* (2006.01)
(Continued)

(52) U.S. Cl.
CPC ..... *B65B 57/20* (2013.01); *B65B 5/103* (2013.01); *B65B 39/007* (2013.01); *A61J 7/02* (2013.01)

(58) Field of Classification Search
CPC .... A61J 7/02; A61J 7/0076; A61J 7/04; G07F 11/44; G07F 17/0092; B65B 57/20; B65B 5/103; B65B 39/007
(Continued)

(56) References Cited

U.S. PATENT DOCUMENTS 2,904,162 A * 9/1959 Simer ..... H01J 9/46 198/380
3,012,651 A * 12/1961 Hawkes ..... B65G 47/1421 198/380
(Continued)

FOREIGN PATENT DOCUMENTS

EP 3147225 A1 3/2017
EP 3147225 A4 * 6/2017 ..... B65G 27/00
(Continued)

*Primary Examiner* — Rakesh Kumar
(74) *Attorney, Agent, or Firm* — Patentfile, LLC; Bradley C. Fach; Steven R. Kick

(57) ABSTRACT

A hybrid counting device may include a number of tray channels, a number of detection channels in which each tray channel may be in communication with a detection channel, and a number of governors. Objects may be motivated from the tray channels and into a detection channel that each tray channel is in communication with. A detection unit may be in communication with each detection channel, and each detection channel may be in communication with one hybrid staging channel or with one supplement staging channel. A supplement staging channel may be in communication with at least one tray channel, and the exit of objects from each supplement staging channel may be controlled by a respective governor. A hybrid staging channel may be in communication with at least two tray channels, and the exit of objects from each hybrid staging channel may be controlled by a respective governor.

14 Claims, 7 Drawing Sheets

(51) Int. Cl.
*B65B 39/00* (2006.01)
*A61J 7/02* (2006.01)

(58) Field of Classification Search
USPC .. 221/10, 7, 200, 277, 202, 2, 157, 160, 12; 198/398, 380, 33
See application file for complete search history.

(56) References Cited

U.S. PATENT DOCUMENTS 3,265,273 A * 8/1966 Janus ..... B31B 50/00 227/2
3,746,211 A * 7/1973 Burgess, Jr. ..... G06M 3/02 221/7
3,747,738 A * 7/1973 Greek ..... B65G 65/44 406/31
3,957,126 A * 5/1976 Hobart ..... G01G 13/24 177/122
4,342,404 A * 8/1982 Baker ..... B65G 11/20 221/10
4,677,283 A * 6/1987 Lewis ..... G06M 7/00 198/383
4,825,995 A * 5/1989 Nalbach ..... B65G 47/1457 198/380
5,065,852 A * 11/1991 Marti ..... B65G 47/1457 198/392
5,317,645 A * 5/1994 Perozek ..... G06M 11/00 209/522
5,419,442 A * 5/1995 Wright, Jr. ..... B07C 5/36 198/391
5,463,839 A * 11/1995 Stange ..... B65B 57/20 53/54
5,507,086 A * 4/1996 Marshall ..... B65C 7/00 29/453
5,638,417 A * 6/1997 Boyer ..... A61J 7/02 377/6
5,671,262 A * 9/1997 Boyer ..... G06M 1/101 377/11
5,713,454 A * 2/1998 Jordan ..... B23P 19/001 198/391
5,804,772 A * 9/1998 Wooldridge ..... G01G 19/42 177/105
5,884,806 A 3/1999 Boyer et al.
6,119,737 A 9/2000 Yuyama et al.
6,435,333 B1 * 8/2002 Sala ..... B65G 47/1457 198/384
6,568,151 B2 * 5/2003 Buckley ..... B65G 15/42 198/803.14
6,578,733 B2 * 6/2003 Geltser ..... G07F 11/00 221/200
6,592,005 B1 7/2003 Coughlin et al.
6,631,799 B2 * 10/2003 Samson ..... B65G 27/04 198/443
6,918,485 B2 * 7/2005 Holston ..... B65B 5/08 198/394
6,966,453 B2 * 11/2005 Tian ..... B65G 47/19 221/200
7,210,598 B2 5/2007 Gerold et
7,571,023 B2 * 8/2009 Mitchell ..... A61J 7/02 221/200
7,878,366 B2 * 2/2011 Cicognani ..... B65G 47/848 221/7
8,006,468 B2 * 8/2011 Bassani ..... B65B 39/06 53/475
8,220,657 B2 * 7/2012 Cicognani ..... B65B 35/14 221/7
8,225,925 B2 * 7/2012 Bassani ..... B65B 5/08 198/758
8,272,534 B2 9/2012 Clarke et al.
8,849,450 B1 9/2014 Balasubramanian et al.
10,102,645 B2 * 10/2018 Chan ..... H04N 5/23229
2002/0096370 A1 * 7/2002 Yonetsu ..... G01G 19/393 177/25.18
2005/0217208 A1 * 10/2005 Cicognani ..... B65B 5/08 53/54
2009/0114665 A1 * 5/2009 Ogawa ..... C23C 14/24 221/2
2010/0096192 A1 * 4/2010 Kawanishi ..... G01G 19/393 177/25.18
2010/0108405 A1 * 5/2010 Kieselhorst ..... G01G 19/393 177/25.18
2011/0088810 A1 * 4/2011 Cicognani ..... B65B 5/103 141/192
2013/0054017 A1 * 2/2013 Horev ..... G06M 7/00 700/240
2013/0144431 A1 * 6/2013 Tidhar ..... G06M 7/02 700/231
2015/0175287 A1 * 6/2015 Tidhar ..... B65B 57/14 700/240
2015/0271399 A1 * 9/2015 Chan ..... G06T 7/0004 348/135
2016/0229575 A1 * 8/2016 Lapointe ..... B65B 57/20
2017/0287161 A1 * 10/2017 Chan ..... B65G 47/31
2018/0122095 A1 * 5/2018 Chan ..... H04N 7/183
2020/0317382 A1 * 10/2020 Savoie-Lavigueur ..... B65B 57/145

FOREIGN PATENT DOCUMENTS

JP 09161037 A * 9/2003 ..... B65B 57/20
JP h09161037 B 9/2003
KR 100759726 B1 10/2007
WO WO-2019122991 A1 * 6/2019 ..... B65B 5/103

* cited by examiner

HYBRID COUNTING DEVICE AND METHOD

This Application is a 35 U.S.C. 371 National Stage Entry of International Application No. PCT/IB2017/058392 filed on Dec. 24, 2017, the entire disclosures of which are incorporated by reference herein.

FIELD OF THE INVENTION

This patent specification relates to the field of devices and methods for counting objects. More specifically, this patent specification relates to a device and method for counting objects with increased counting capacity.

BACKGROUND

Counters for counting tablets, capsules, caplets, and other objects have been known to industry for some time. Generally, it is a common practice of such counters to feed a collection of objects in a manner which permits the objects to be counted as they move past a sensor, such as an optical sensor. For example, these counters may include a Counting and control computer (in short "controller") that will drive a linear vibrator feeder motor which in turn excites a linear vibrator tray (in short "vibrator"). The objects will move in a forward motion towards vertical product guide (in short "product guide"). The objects may pass the product detector, be counted by the controller, and then follow a downwards path through the product guide and a funnel into a container where all the counted objects are collected. A user sets the desired quantity of objects via the controller. Once this desired quantity of objects has been counted by controller, the controller will take action to prevent more objects from entering the container. This prevention is done by trapping the extra objects onto slides that were pushed forward by actuators. The quantity of trapped objects is memorized by the controller. Once the object that completed the desired quantity has entered the container, container is removed and a new empty container is placed underneath the funnel. At this time, the controller excites the actuators which pull the slides to their home positions so that the memorized objects and subsequent products can flow into the newly placed container until the desired quantity of objects is met again. This process repeats so that every container has the desired quantity of objects. It is common with existing counters that the number of channels on vibratory tray is equal to the number of slides (assuming 1 slide has been used per catching/trapping channel) and that the slides close after the desired quantity has been reached. These limitations govern the counting capacity, cost, size, and number of components that each counter requires.

Therefore a need exists for novel devices and methods for counting objects. A further need exists for novel devices and methods which provide for increasing capacity of conventional product counting machines without changing their overall dimensions. There is also a need for novel devices and methods for counting objects which are not limited to having the number of channels on vibratory tray being equal to the number of slides.

BRIEF SUMMARY OF THE INVENTION

A hybrid counting device is provided. The device may be used to count objects and to communicate a desired number of the objects into a container. In some embodiments, the device may include an object feeder having a number of tray channels, a number of detection channels in which each tray channel may be in communication with a detection channel, and a number of governors. A detection unit may be in communication with each detection channel, and each detection channel may be in communication with a hybrid staging channel or with a supplement staging channel. A hybrid staging channel may be in communication with at least two tray channels, and the exit of objects from each hybrid staging channel may be controlled by a respective governor. A supplement staging channel may be in communication with a tray channel, and the exit of objects from each supplement staging channel may be controlled by a respective governor. Objects may be motivated from the tray channels and into the detection channel that each tray channel is in communication with. A hybrid staging channel may receive objects from at least two tray channels, via at least one detection channel, and in this manner, the governor of the hybrid staging channel may control the dispensing of objects from two or more tray channels and one or more detection channels, thereby eliminating the limitations of currently available counting apparatuses which require the number of channels on the tray to be equal to the number of slides.

In further embodiments, the device may include a processing unit which may be in communication with the detection unit, governors, and a motor that is configured to drive or activate the object feeder.

In still further embodiments, the processing unit may control a first governor to stop the exit of objects from a hybrid staging channel after a predetermined first number of objects passes into the hybrid staging channel(s) and into the supplement staging channel(s).

In still further embodiments, the processing unit may control a second governor to stop the exit of objects from the supplement staging channel(s) after a predetermined second number of objects passes into the supplement staging channel(s).

In yet further embodiments, the processing unit may control a first governor to stop the exit of objects from a hybrid staging channel after a predetermined first number of objects passes into the hybrid staging channel and into the supplement staging channel(s) and before controlling a second governor to stop the exit of objects from the supplement staging channel(s).

According to another aspect consistent with the principles of the invention, a method for counting objects is provided. The method may be used to count objects passing from an object feeder to one or more hybrid staging channels and supplement staging channels and to communicate a desired number of the objects into a container. The method may include: activating an object feeder having one or more tray channels to communicate objects from one or more tray channels into one or more detection channels; detecting a predetermined first number of objects passing from the detection channels into a hybrid staging channel and into at least one supplement staging channel; stopping the exit of objects from the hybrid staging channel; detecting a predetermined second number of objects passing from the detection channels into the supplement staging channels; and stopping the exit of objects from the supplement staging channels.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
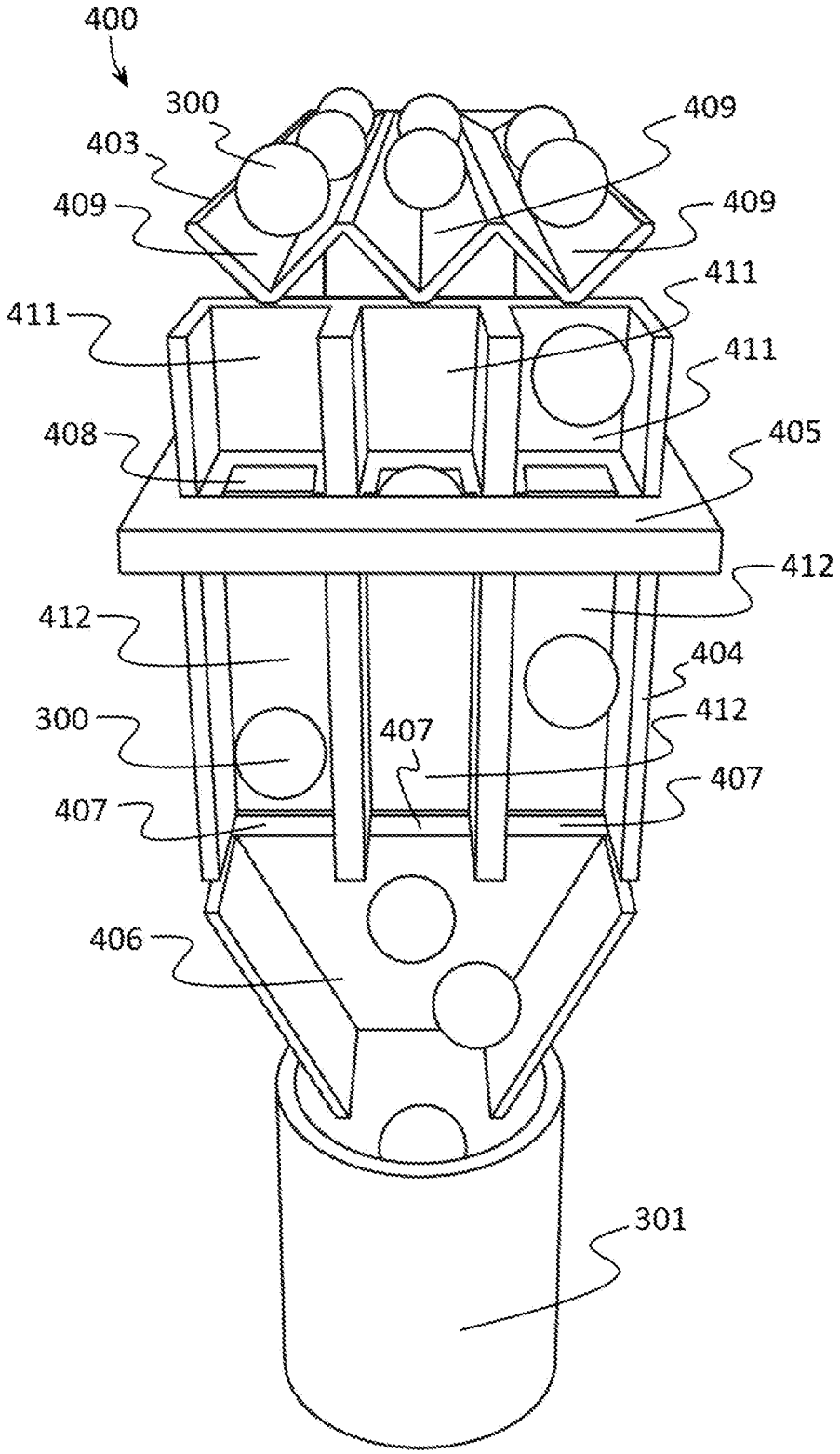
FIG. 1 PRIOR ART
FIG. 1 depicts a front perspective view of an example of a currently available counting apparatus.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New devices and methods for counting objects are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of a currently available counting apparatus 400 which is configured to count a number of objects 300 and to deposit the counted objects 300 into a container 301. Typically, a currently available counting apparatus 400 may include a counting and control computer ("controller") which may drive a vibrator feeder motor which in turn excites a linear vibrator tray (in short "tray") 403. The objects 300 will move in a forward motion within the channels 409 on the tray 403 towards vertical product guide ("product guide") 404. The product guide 404 will have a number of detection channels 411 and a number of staging channels 412 with the number of detection channels 411 and staging channels 412 being equal. Additionally, the number of tray channels 409 is also equal to the number of detection channels 411 and staging channels 412. The objects 300 passing the object detector 405, having a number of detection sensors 408, are counted by the controller and then follow a downwards path through the object guide 404 (forming the staging channels 412) and funnel 406 into a container 301 where all objects 300 are collected. The number of channels 409 being equal to the number of slides 407. A user sets the desired quantity of objects 300 to be provided to the container 300 via the controller. Once this desired quantity of objects 300 has been counted by controller, the controller will take action to prevent more objects 300 from entering the container 301. This prevention is done by trapping the extra objects 300 onto slides 407 that were pushed forward by actuators 408. The quantity of trapped objects 300 is memorized by the controller. Once the object 300 that completed the desired quantity has entered the container 301, the container 301 is removed and a new empty container 301 is placed underneath the funnel 406. At this time, the controller excites the actuators 408 which pull the slides 407 to their home positions so that the memorized objects 300 and subsequent objects 300 can flow into the newly placed container 301 until the desired quantity of objects 300 is met again. This process repeats so that every container 301 has the desired quantity of objects 300.

An example method of operation of a currently available counting apparatus 400 is provided. Assuming the operator has set a desired quantity of 100 objects 300, at a certain moment object number 95 has just entered container 301 and the slides 407 are still in their home or open position 91. Once object 300 number 100 has been detected by the object detector 405, the controller takes action for the next objects 300 that will pass the object detector 405. After object 300 number 101 has been detected by the object detector 405 the controller controls a slide 407 below that object detector 405 to be pushed forward or into the closed position 92 and trap object 300 number 101 where it will be memorized by the controller. Next, the product detector 405 may detect object 300 number 102 and the controller may control the slide 407 below that object detector 405 to be pushed forward and trap object 300 number 102 where it will be memorized by controller. The container with the 100 objects 300 may be removed, and a new empty container 301 may be placed underneath the funnel 406. In the time required to place the new empty container 301, a product detector 405 may then detect object number 103 and the controller may control the slide 407 below that object detector 405 to be pushed forward and trap object 300 number 103 where it will be memorized by controller. Once the new empty container 301 is placed, the controller may control the slides 407 to be returned to their home or open positions 91, thereby releasing the memorized objects 300 (object numbers 101, 102, 103) to fall into the container 300 and opening the downwards pathway for any subsequent objects 300. The currently available counting apparatus 400 will stay in this condition until the new container 301 approaches the desired quantity of objects 300 which in this example is 100 objects 300 and then the process may be repeated.

From this example, it can be seen that currently available counting apparatuses 400 require the number of channels 409 on the tray 403 to be equal to the number of slides 407. The one to one ratio of channels 409 to slides 407 dictates size requirements and contributes to the cost of currently available counting apparatuses 400. Additionally, currently available counting apparatuses 400 require the slides 407 to close after the desired quantity of objects 300 has been reached.

Figure 2:
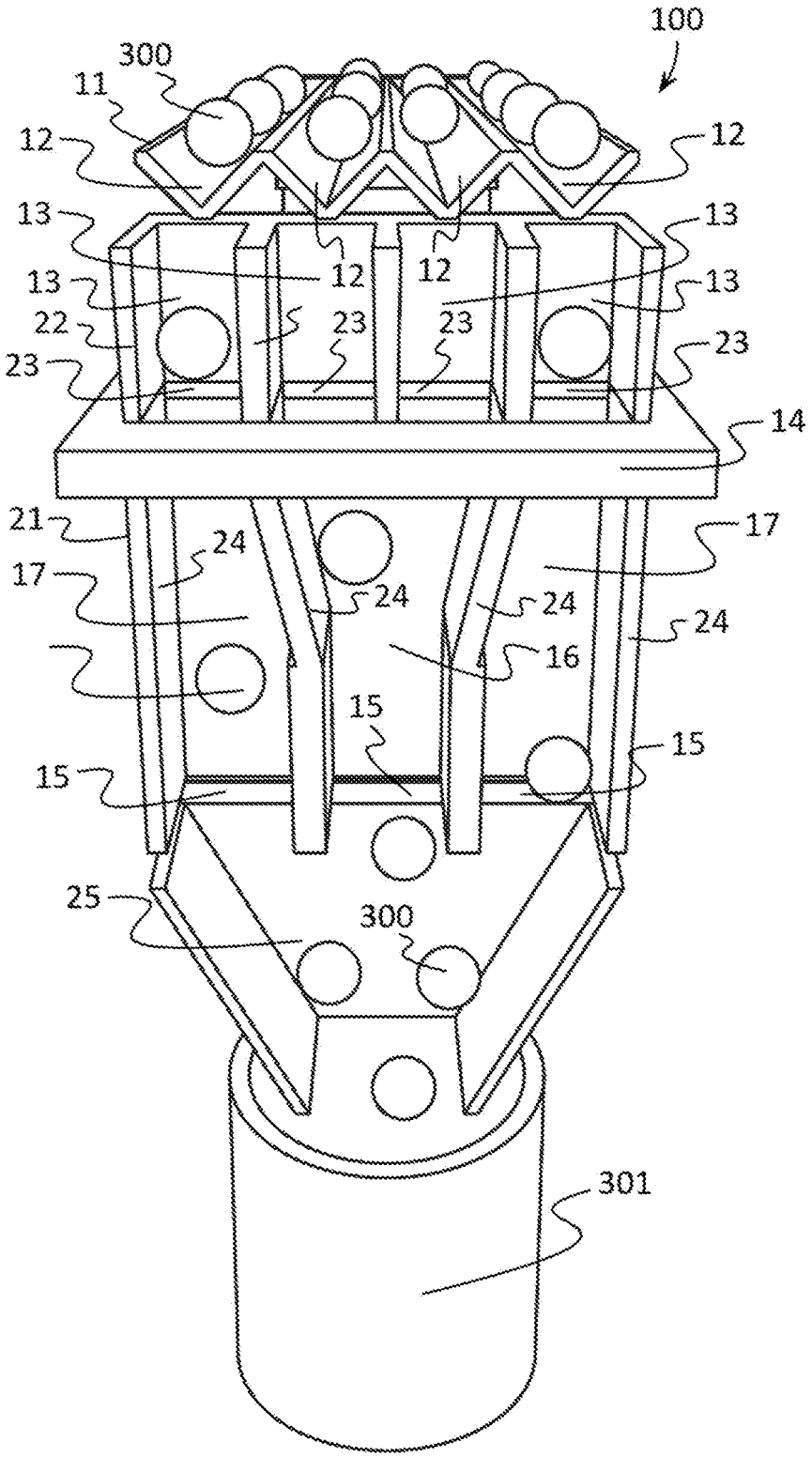
FIG. 2 illustrates a front perspective view of an example of a hybrid counting device according to various embodiments described herein.
Figure 3:
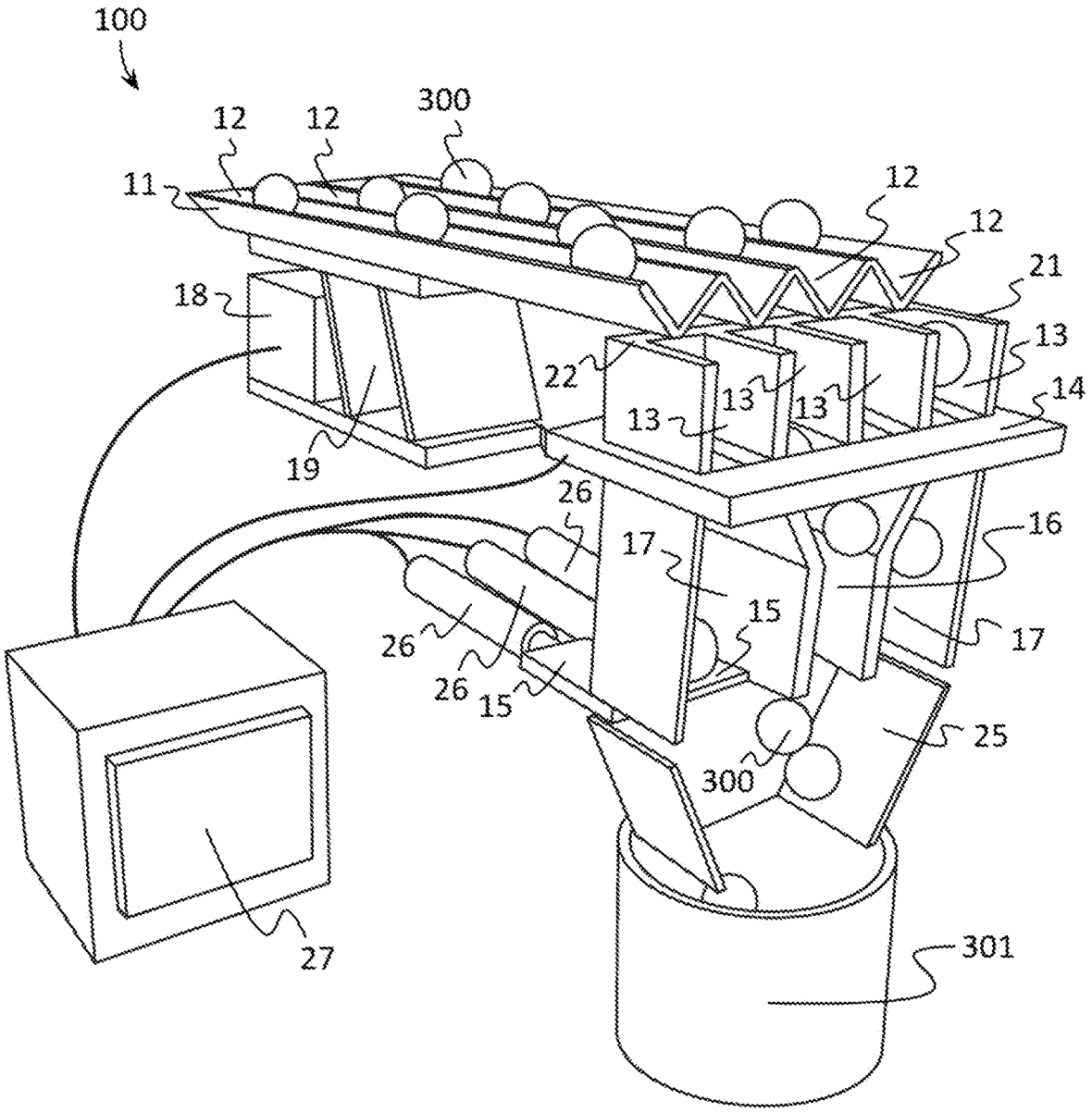
FIG. 3 shows a side perspective view of an example of a hybrid counting device according to various embodiments described herein.
Figure 4:
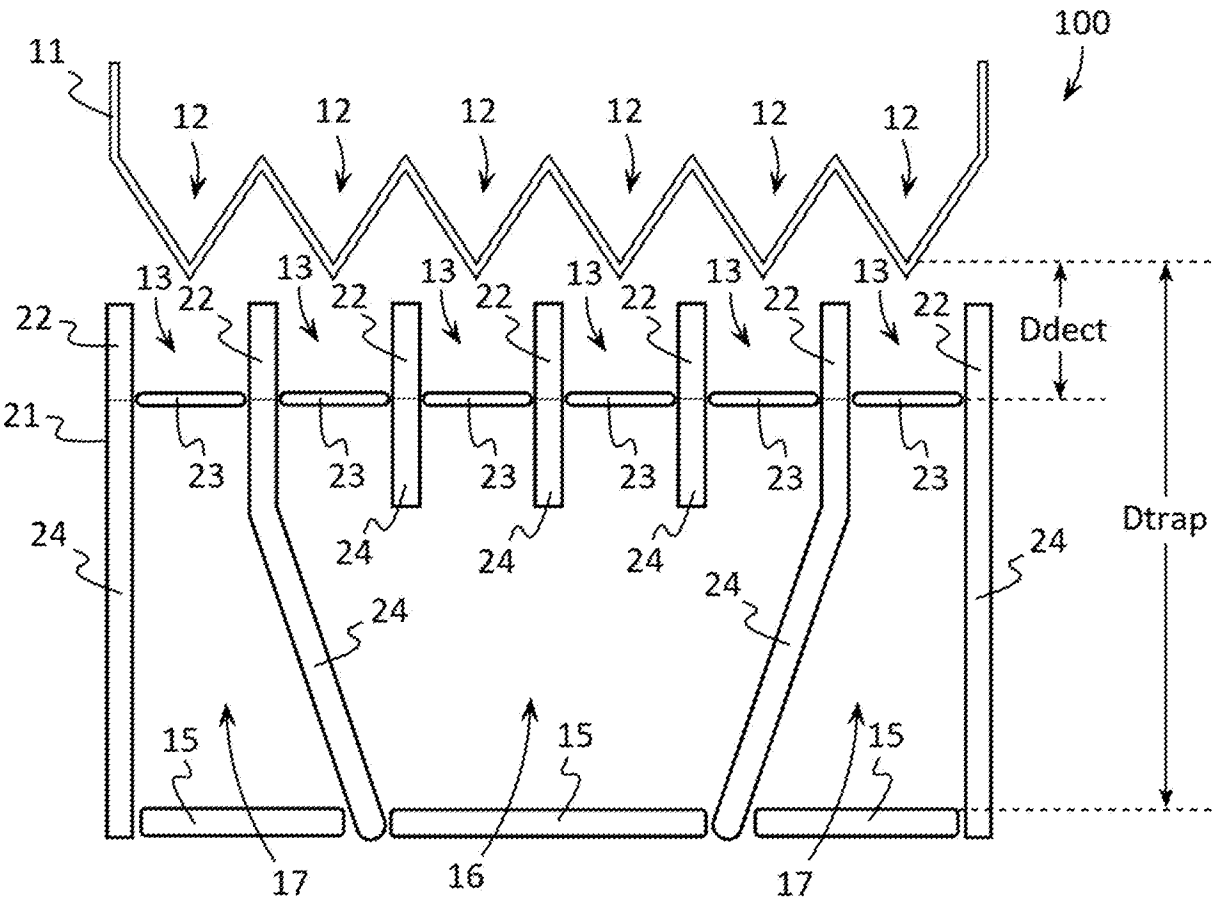
FIG. 4 depicts a schematic diagram of some of the components of an example of a hybrid counting device according to various embodiments described herein.

FIGS. 2-4 depict examples of the hybrid counting device ("the device") 100 which is not limited by the requirements of currently available counting apparatuses 400. In some embodiments, the device 100 may comprise an object feeder 11 having a number of tray channels 12, a number of detection channels 13 in which each tray channel 12 may be in communication with a detection channel 13, and a number of governors 15. A detection unit 14 may be in communication with each detection channel 13, and each detection channel 13 may be in communication with a hybrid staging channel 16 or with a supplement staging channel 17. A hybrid staging channel 16 may be in communication with at least two tray channels 12, via one or more detection channels 13, and the exit of objects 300 from each hybrid staging channel 16 may be controlled by a respective governor 15. A supplement staging channel 17 may be in communication with at least one detection channel 13, and the exit of objects 300 from each supplement staging channel 17 may be controlled by a respective governor 15. In further embodiments, a detection channel 13 may be in communication with at least two tray channels 12. Objects 300 may be motivated from the tray channels 12 and into the detection channel 13 that each tray channel 12 is in communication with. A hybrid staging channel 16 may receive objects 300 from at least two tray channels 12 and in this manner, the governor 15 of the hybrid staging channel 16 may control the dispensing of objects 300 from two or more tray channels 12 and one or more detection channels 13, thereby eliminating the limitations of currently available counting apparatuses 400 which require the number of channels 409 on the tray 403 to be equal to the number of slides 407.

The device 100 may comprise an object feeder 11 having a plurality of tray channels 12. In some embodiments, a plurality of tray channels 12 may comprise approximately between two and four tray channels 12. In further embodiments, a plurality of tray channels 12 may comprise approximately between two and ten tray channels 12. In still further embodiments, a plurality of tray channels 12 may comprise approximately between two and twenty tray channels 12. In yet further embodiments, a plurality of tray channels 12 may comprise approximately between two and fifty tray channels 12. In still further embodiments, a plurality of tray channels 12 may comprise approximately between two and one hundred tray channels 12. For example, an object feeder 11 may comprise three, four, five, seven, ten, fifteen, thirty, or more tray channels 12. Preferably, an object feeder 11 may be made from or comprise a substantially rigid material such as steel alloys, aluminum, aluminum alloys, stainless steel, other types of metal or metal alloy, ceramics such as alumina, porcelain, and boron carbide, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, or any other substantially rigid material including combinations of materials. The tray channels 12 may be formed, molded, or otherwise shaped or coupled to the object feeder 11. In preferred embodiments, the device 100 may comprise or be configured to accept two or more interchangeable object feeders 11 that may have differing numbers of tray channels 12.

Generally, each tray channel 12 may be elongated in shape and positioned on the tray to extend from one end of the object feeder 11 to an opposing end. Tray channels 12 may be sized and shaped to receive any number of objects 300. Each tray channel 12 may be configured to allow only one object 300 to exit that respective tray channel 12 at a time. In this manner, each tray channel 12 may communicate objects 300 into a detection channel 13, and therefore into a hybrid staging channel 16 or a supplement staging channel 17, in a single file or sequential manner. In some embodiments, all or portions of each tray channel 12 may be shaped so that the objects 300 in single tray channel 12 may only proceed through the tray channel 12 in a single file line so that only one object 300 may exit the tray channel 12 at one time. In further embodiments, the tray channels 12 may comprise a generally elongated triangular prism shape which may extend from one end of the object feeder 11 to an opposing end. In other embodiments, a tray channel 12 may be configured in any other shape and size. In some embodiments, the number of tray channels 12 may be equal to the number of detection channels 13. In further embodiments, the number of tray channels 12 may be greater than the number of governors 15.

In some embodiments, objects 300 may be motivated from one end of the object feeder 11 through the tray channels 12 by angling the tray channels 12 relative to gravity and vibrating the tray channels 12. In some embodiments, the device 100 may comprise a motor 18 which may be coupled to the object feeder 11 via one or more movable supports 19. A motor 18 may be configured to drive, such as by rotating, vibrating, shaking, or otherwise producing any other series of rapid and repeated movements which may be used to motivate objects 300 from an object feeder 11. A motor 18 may comprise a long life brushless (BLDC) vibration motor, a coin or pancake vibration motor, an encapsulated vibration motor, an enclosed vibration motor, a pager motor, an eccentric rotating mass (ERM) motor, a linear resonant actuator (LRA), a printed circuit board (PCB) mounted vibration motor, or any other device capable of producing a series of movements which may be used to motivate objects 300 from an object feeder 11. A movable support 19 may comprise any object or material which may be able to communicate vibrations from the motor 18 to the object feeder 11. In alternative embodiments, an object feeder 11 may comprise any other device or method having a number of tray channels 12 in which each tray channel 12 may be configured to allow only one object 300 to exit a tray channel 12 at a time. For example, an object feeder 11 may comprise a rotary drum which may communicate or motivate objects 300 into tray channels 12 with each tray channel 12 allowing only one object 300 to exit a tray channel 12 at a time. As another example, an object feeder 11 may comprise one or more conveyor belts which may function as or be in communication with tray channels 12 with each tray channel 12 allowing only one object 300 to exit a tray channel 12 at a time. As yet another example, an object feeder 11 may comprise two or more rollers which may function as or be in communication with tray channels 12 with each tray channel 12 allowing only one object 300 to exit a tray channel 12 at a time. The device 100 may comprise one or more detection channels 13 which may be housed or formed in a guide block 21. Preferably, each tray channel 12 may be in communication with one or more detection channels 13 so that objects passing from a tray channel 12 may pass into a detection channel 13 in a single file or sequential manner. In some embodiments, the detection channels 13 may be formed by one or more detection walls 22. The detection walls 22 may be of any size and shape to form detection channels 13 which may be generally sized and shaped so that an object 300 communicated, such as by gravity, from a tray channel 12 may freely pass through the detection channel 13 and into a staging channel 16, 17. In further embodiments, the device 100 may comprise or be configured to accept two or more interchangeable guide blocks 21 or other enclosures that may have differing numbers of detection units 14 and/or differing numbers of detection channels 13.

Each detection channel 13 may be in electrical communication with a detection unit 14, and the detection unit 14 may be configured to detect each object 300 that passes through the detection channels 13. An exemplary detection unit 14 may comprise a number of detection sensors 23 with one or more detection sensors 23 disposed in or towards each detection channel 13, and the detection sensors 23 may detect the absence or presence of an object 300 in a respective detection channel 13. Preferably, a detection sensor 23 may comprise a photoelectric sensor having a light transmitter, often infrared, and a photoelectric receiver. In alternative embodiments, a detection unit 14 may comprise detection sensors 23 which may be any other type of sensor which may be used to count objects as they pass through a detection channel 13.

Preferably, each detection channel 13 may be in communication with a hybrid staging channel 16 or a supplement staging channel 17 so that an object passing through a detection channel 13 may pass into a hybrid staging channel 16 or a supplement staging channel 17. A device 100 may comprise any number of hybrid staging channels 16 and supplement staging channels 17, and the staging channels 16, 17, may be housed or formed in a guide block 21 below the detection channels 13. In some embodiments, the staging channels 16, 17, may be formed by one or more staging walls 24. The staging walls 24 may be of any size and shape to form staging channels 16, 17, which may be generally sized and shaped so that an object 300 communicated, such as by gravity, from a staging channel 16, 17, may freely pass from the staging channel 16, 17, and into a funnel 25 and/or container 301 below when allowed by a governor 15.

Generally, a supplement staging channel 17 may be in communication with at least one tray channel 12 via one or more detection channels 13, while a hybrid staging channel 16 may be in communication with two or more tray channels 12 via one or more detection channels 13. In preferred embodiments, each supplement staging channel 17 may accept a single stream of sequentially aligned objects 300 and each hybrid staging channel 16 may accept two or more streams of sequentially aligned objects 300. For example, the hybrid staging channel 16 of FIGS. 2 and 3 is in communication with two detection channels 13, and the hybrid staging channel 16 of FIG. 4 is in communication with four detection channels 13. Staging channels 16, 17, may be formed by the staging walls 24 to contain or stage objects 300 entering the staging channels 16, 17, until the respective governor 15 for a desired channel is operated to allow the objects 300 to pass by the governor 15. In further preferred embodiments, the staging walls 24 of a supplement staging channel 17 may be aligned with the detection walls 22 of its respective detection channel 13, the staging walls 24 of a hybrid staging channel 16 may be aligned with the two outside staging walls 24 of the detection channel 13 which it is in communication with. Preferably, the number of detection channels 13 may be greater than the number of governors 15.

Each staging channel 16, 17, may be in communication with a governor 15, and the governor 15 for a respective staging channel 16, 17, may control or govern the exit of objects 300 from its respective staging channel 16, 17. For example, a device 100 comprising two supplement staging channels 17 and one hybrid staging channel 16 as shown in FIGS. 2-4 may comprise three governors with each staging channel 16, 17, having its own governor 15. In some embodiments, a governor 15 may be moved linearly between an open position 91 and a closed position 92 in which objects 300 may exit a staging channel 16, 17, when the governor 15 is in the open position 91 and objects 300 may not exit a staging channel 16, 17, when the governor 15 is in the closed position 92. Preferably, a linearly moved governor 15 may be operated by a linear actuator 26. In other embodiments, a governor 15 may comprise any type of shutter, gate, door, or the like which may be used to govern the exit of objects from a staging channel 16, 17.

As shown in FIG. 4, the tray channels 12 may be separated from the detection sensor 23 in the detection channel 13 that each tray channel 12 is in communication with by the detection distance (Ddect). Preferably, the Ddect between each tray channel 12 and its respective detection channel 13 may be approximately equal to the Ddect between the other tray channels 12 and their respective detection channels 13. Additionally, the tray channels 12 may be separated from the governor 15 of the staging channel 16, 17, that each tray channel 12 is in communication with, via their respective detection channel 13, by the trap distance (Dtrap). Preferably, the Dtrap between each tray channel 12 and its respective governor 15 may be approximately equal to the governor 15 between the other tray channels 12 and their respective governors 15. In some embodiments, Dtrap may be approximately between one and fifty times Ddect. In further embodiments, Dtrap may be approximately between two and ten times Ddect. In still further embodiments, Dtrap may be approximately between four and seven times Ddect. In yet further embodiments, Dtrap may be greater than Ddect.

The governors 15 cannot close at any given moment as care needs to be taken that they don't impact any objects 300 and cause damage to the objects 300 or even cause a miscount in the container 301 whereby the quantity of objects 300 that have entered the container 301 is not equal to the desired quantity of objects 300 to be deposited in the container(s) 301.

Figure 5:
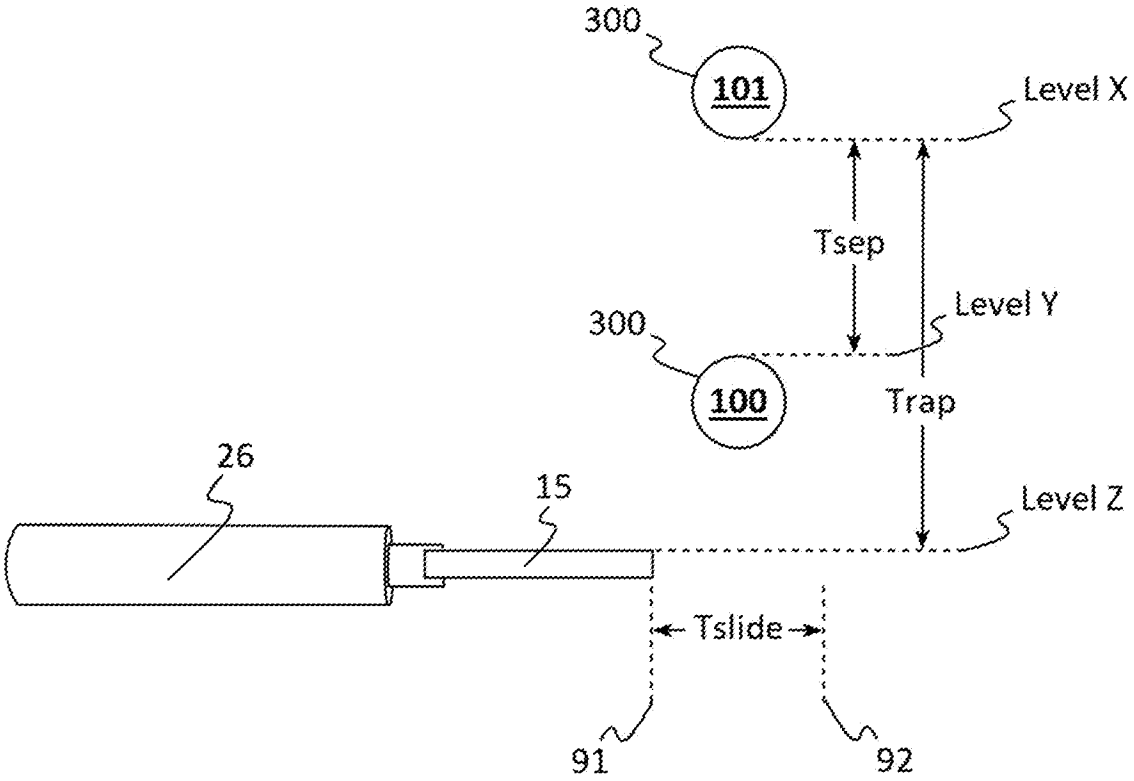
FIG. 5 illustrates a side elevation view of an example of a governor according to various embodiments described herein.

FIG. 5 shows the motion of an object 300 and a governor 15 at the moment an object 300 needs to be trapped by a governor 15. For example, if the desired number of objects to be deposited in a container 301 is one hundred, the object 300 number 101 needs to be trapped by a governor 15, preferably a governor 15 of a supplement staging channel 17, while allowing object 300 number 100 to fall downwards to land into the container 301. The time it takes object 300 number 101 to fall from level X to level Z (and past level Y) is the Trap Time (Ttrap). Ttrap is dependent on the current downwards velocity of object 300 number 101 and its gravitational acceleration. The distance (in units of time) between object 300 number 101 and its predecessor object 300 number 100 (time distance X-Y) is the Separation Time (Tsep). The governor 15 will move at a certain speed from open position 91 to closed position 92 once linear actuator 26 is energized. The time it takes for governor 15 to move from open position 91 to closed position 92 is the Slide time (Tslide).

It is important that Tsep is greater than or equal to Tslide. If Tsep was slightly smaller than Tslide, the governor 15 will hit the top of object 300 number 100 and may cause damage. If Tsep was significantly smaller than Tslide, the governor 15 might hit the bottom of object 300 number 100 and cause it to get trapped together with object 300 number 101, leaving a container 301 with one object 300 less than the desired quantity.

In conventional product counting machines, this doesn't play much of a role as Tsep will in normal situations always be larger than Tslide. The object feeder 11 will feed objects 300 at a certain speed (for example 120 mm/sec) and due to the length of the objects 300 (say 10 mm) it is given that the object feeder 11 will feed a maximum of 12 objects 300 per tray channel 12 per second (120 mm per second divided by 10 mm per object), which is approximately one object 300 every 83 ms. The downwards speed of the object 300 is approximately 1 mm/ms which would mean that Tsep is around 73 ms (83 ms-10 ms) while the governor 15 usually moves from A to B in approximately 25-50 ms, there is enough time available to catch the object 300. In case the object 300 is relatively small and the motor 18 speed is high, it can happen that Tsep is smaller than Tslide, in this case some conventional product counting machines have the option to slow down the motor 18 speed before the desired quantity of objects 300 has been reached. For example, one can count on high speed with a Tsep smaller than Tslide for the first ninety objects 300 and then the ten objects 300 will be counted at a lower "separation" speed to ensure Tsep will be larger than Tslide.

In preferred embodiments, the device 100 may comprise or be in communication with a processing unit 27 which may be configured to control the functions of the governors 15 and motor(s) 18 of the device 100 while receiving object 300 count information from the detection unit 14. Generally, a processing unit 27 may be a digital device that, in terms of hardware architecture, may include a processor, input/output (I/O) interfaces, a data store, and memory. It should be appreciated by those of ordinary skill in the art that the processing unit 27 is described in an oversimplified manner, and a practical embodiment may include additional components or elements and suitably configured processing logic to support known or conventional operating features that are not described in detail herein. A processing unit 27 may comprise a microcontroller, computer, or any other computing device.

In some embodiments, a processing unit 27 may control a first governor 15 to stop the exit of objects 300 from a hybrid staging channel 16 after a predetermined first number of objects 300 passes into the one or more hybrid staging channels 16 and into the one or more supplement staging channels 17. In further embodiments, a processing unit 27 may control a second governor 15 to stop the exit of objects 300 from a supplement staging channel 17 after a predetermined second number of objects passes into the one or more supplement staging channels 17. In further embodiments, a processing unit 27 may control a first governor 15 to stop the exit of objects 300 from one or more hybrid staging channels 16 after a predetermined first number of objects 300 passes into the one or more hybrid staging channels 16 and into one or more supplement staging channels 17 and before controlling a second governor 15 to stop the exit of objects 300 from the one or more supplement staging channels 17.

Figure 6C:
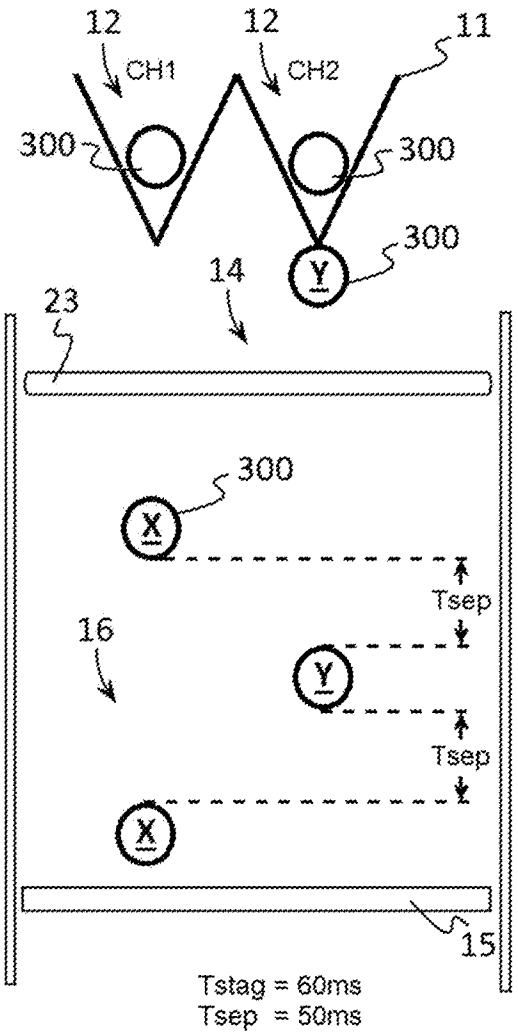
FIG. 6C illustrates a schematic diagram of a third example scenario in which two objects exiting tray channels of a hybrid counting device according to various embodiments described herein.
Figure 6B:
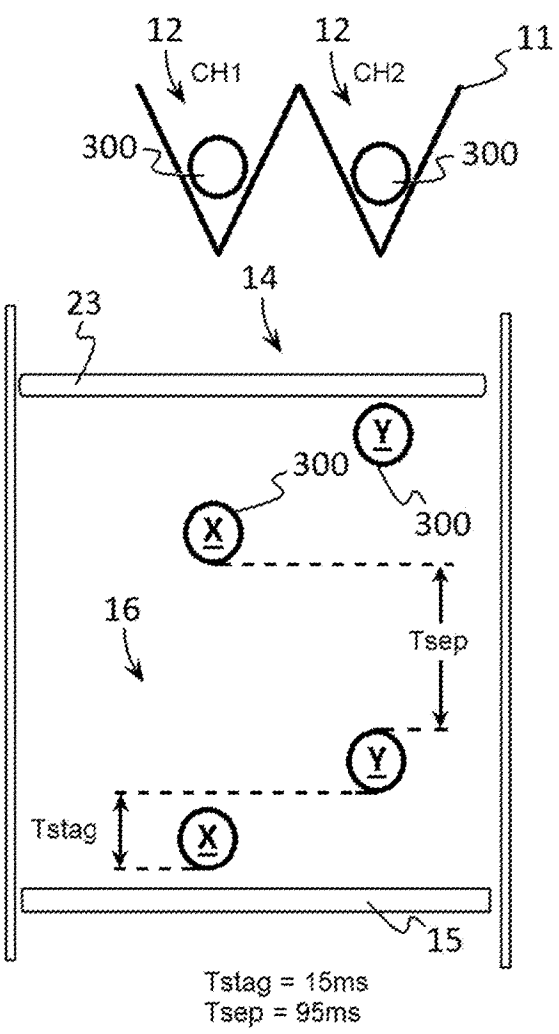
FIG. 6B depicts a schematic diagram of a second example scenario in which two objects exiting tray channels of a hybrid counting device according to various embodiments described herein.
Figure 6A:
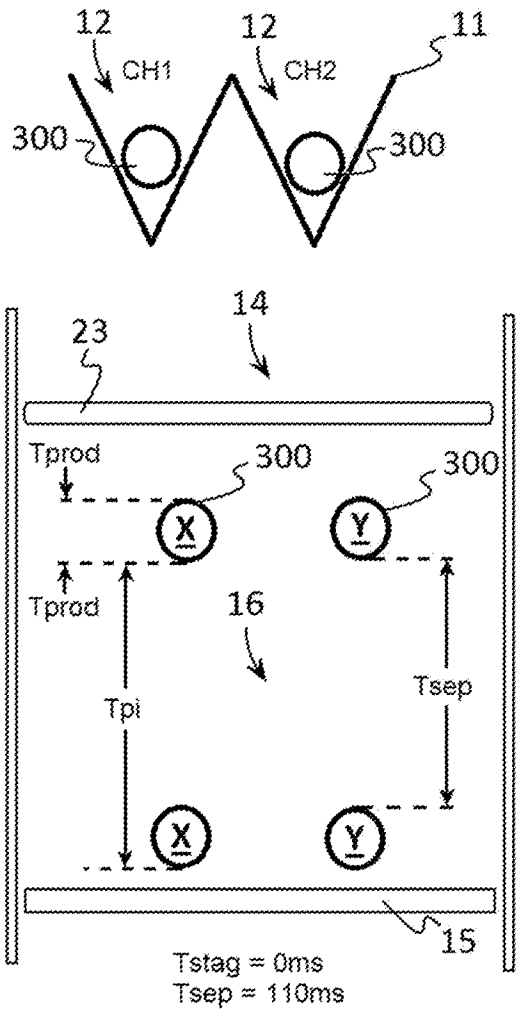
FIG. 6A shows a schematic diagram of a first example scenario in which two objects exiting tray channels of a hybrid counting device according to various embodiments described herein.

In some embodiments, two or more tray channels 12 may be configured to communicate objects 300 into a single detection channel 13 and subsequently into a single hybrid staging channel 16 as shown in FIGS. 6A-6C which depict schematic diagrams of three example scenarios in which two objects 300 are shown exiting tray channels 12 into a single detection channel 13 and subsequently into a single hybrid staging channel 16 according to various embodiments described herein. The hybrid counting device 100 offers significant advantages over currently available counting apparatuses 400 because a time frame in which a governor 15 of a hybrid staging channel 16 should close can be calculated. This is because the objects 300 will come off the object feeder 11 at a reasonably constant interval per tray channel 12. In some currently available counting apparatuses 400 (FIG. 1), this is not the case, as any object(s) 300 can fall at any random moment, the only way to guarantee the slides 407 can close is by stopping the bulk tray 403. With the hybrid counting device 100, in most cases it wouldn't be necessary to stop the object feeder 11. In case Tsep is smaller than Tslide during the normal counting cycle 203, the gap (Tsep) between the objects 300 can be increased simply by reducing the feed rate of the object feeder 11 during the calculated time frame where governor 15 needs to close. Whenever an object 300 feed is slowed down (or stopped) it will cost capacity, so it is desirable to minimize this as much as possible to gain the highest increase in overall capacity as the hybrid counting device 100 provides.

FIGS. 6A-6C depict schematic diagrams of three example scenarios in which a time frame in which a governor 15 of a hybrid staging channel 16 can close can be calculated. As illustrated in these examples, a first tray channel 12 (CH1) and a second tray channel 12 (CH2) are shown communicating a first object 300 (object X) and a second object 300 (object Y), respectively. FIG. 6A depict schematic diagram of a first example scenario in which object X and object Y exit CH1 and CH2 at the same time. FIG. 6B depict schematic diagram of a second example scenario in which object Y exits CH2 15 milliseconds after object X exits CH1. FIG. 6C depict schematic diagram of a third example scenario in which object Y exits CH2 at half the object interval time (Tpi) after object X exits CH1. Object time (Tprod) describes the amount of time it takes the length of an object 300 to pass by a point in space as it is being communicated into a staging channel 16, 17. Object separation time (Tsep) describes the amount of time two sequential objects 300 are separated by as they are being communicated into a staging channel 16, 17. Object staggering time (Tstag) describes the amount of time two objects 300 feed into the same staging channel 16, 17, are separated by. Using these variables, Object separtation time (Tsep) can be calculated by Equation A.

$$Tsep=(Tpi-Tprod-Tstag) \quad \text{Equation A:}$$

Referring to FIGS. 6A-6C, suppose the object 300 feed rate is chosen as such that the object interval time (Tpi) is 120 ms. Now, the precise moment that an object 300 will fall from CH1 or CH2 is not known, but it is known that they fall with a given interval that is reasonably constant (for example, single file of objects 300 fall at a constant rate given a constant tray 11 vibration speed or other constant tray 11 feeding rate). Therefore, it is known that the object X and object Y will exit anywhere between these three example scenarios. Therefore, it is also known that when Tslide (FIG. 5) is smaller than 50 ms, there will always be a moment the governor 15 of the hybrid staging channel 16 that object X and object Y will enter can close if it is given a window from 0 to the object interval time (Tpi) of 120 ms. So although it is not known exactly when the governor 15 will close, it is known that it will close within the object interval time (Tpi) of 120 ms window without needing to stop or halt the object feeder 11. This time window will increase when more tray channels 12 are feeding a single hybrid staging channel 16, but there is always a window that can be calculated in which it is known that the governor 15 of that hybrid staging channel 16 will be able to close.

Figure 7:
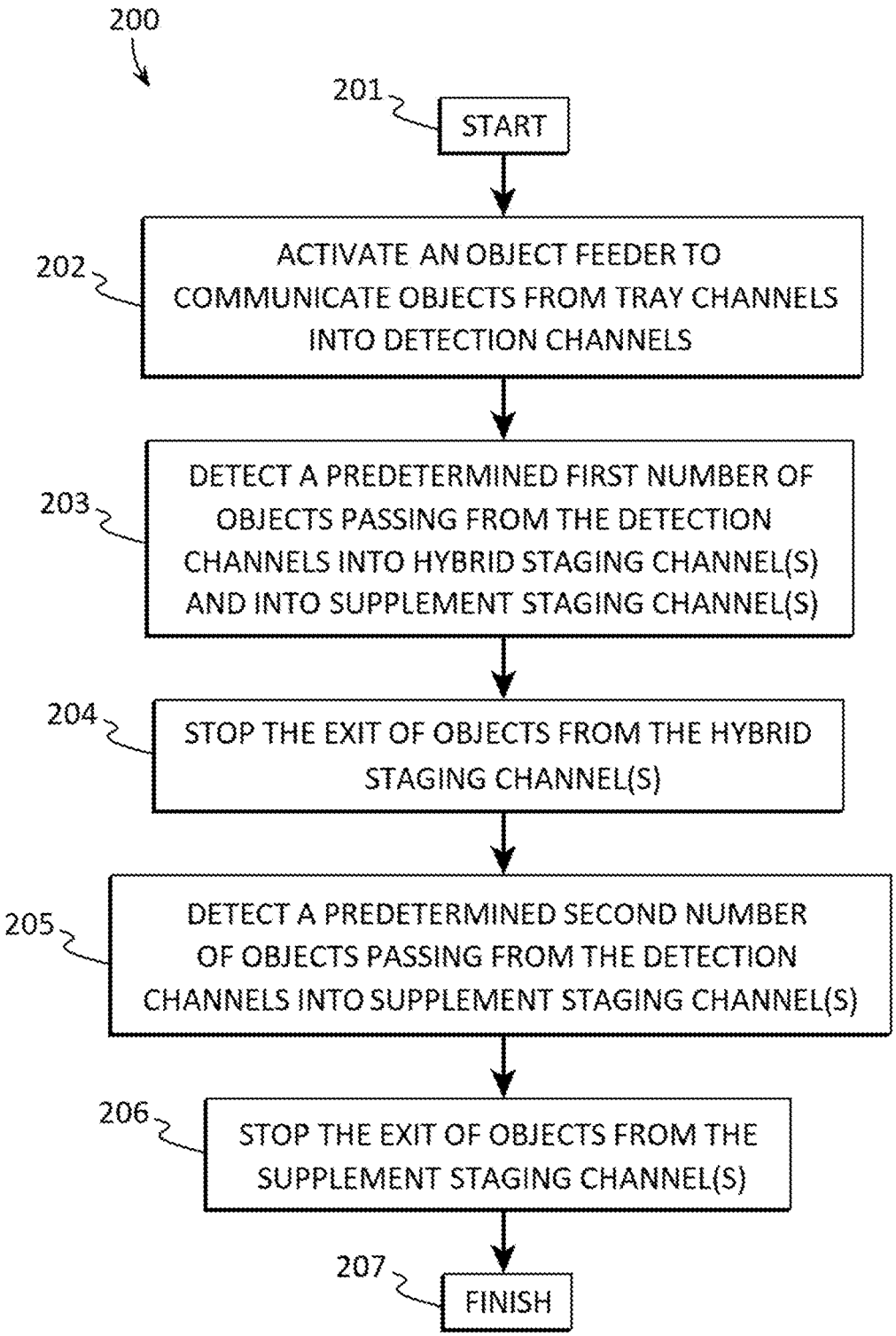
FIG. 7 shows a block diagram of an example of a method for counting objects according to various embodiments described herein.

FIG. 7 shows a block diagram of an example of a method for counting objects ("the method") 200 according to various embodiments described herein. In preferred embodiments, the method 200 may be used to count objects 300 passing from an object feeder 11 to the staging channels 16, 17, and to communicate a desired number of the objects 300 into a container 301. As an example, the method 200 will be described as communicating a desired number of the objects 300 into a container 301 in which the desired number of objects 300 is one thousand. Optionally, the method 200 may be performed by a hybrid counting device 100.

In some embodiments, the method 200 may start 201 and an object feeder 11 having one or more, such as a plurality of, tray channels 12 may be activated to communicate objects 300 from the one or more tray channels 12 into one or more detection channels 13 in step 202. In preferred embodiments, each tray channel 12 may be configured to allow only one object 300 to exit that respective tray channel 12 at a time. In further preferred embodiments, a processing unit 27 may be in communication with a motor 18, and the processing unit 27 may activate the motor 18 to cause the object feeder 11 to be activated to result in objects 300 being motivated to exit the tray channels 12.

In step 203, a predetermined first number of objects 300 passing from the detection channels 13 into a hybrid staging channel 16 and into at least one supplement staging channel 17 may be detected. The predetermined first number of objects 300 is less than the desired number of objects 300 and may be based on Tsep, Ttrap, and/or Tslide or may be based on any other criteria. Continuing the above example, the predetermined first number of objects 300 may be 990. As objects 300 pass through the detection channels 13, a detection unit 14 in communication with the processing unit 27 may provide information to the processing unit 27 which enables the processing unit 27 to determine the number of objects 300 that passed through the detection channels 13 into the staging channels 16, 17.

Next in step 204, the exit of objects 300 from a hybrid staging channel 16 may be stopped via the governor 15 of that respective hybrid staging channel 16. In preferred embodiments, if more than one hybrid staging channel 16 is in operation, then one or more, and preferably all, hybrid staging channels 16 may be stopped via their respective governors 15. Each governor 15 may be in communication with the processing unit 27, and the processing unit 27 may operate the respective governor(s) 15 to stop the exit of objects 300 from the hybrid staging channel(s) 16. While objects 300 may be prevented from exiting the hybrid staging channel(s) 16, objects may still enter the hybrid staging channel(s) 16 and the processing unit 27 may track or memorize the number of objects 300 that have entered the hybrid staging channel(s) 16.

In step 205, a predetermined second number of objects 300 passing from the detection channels 13 into one or more supplement staging channels 17 may be detected. The predetermined second number of objects 300 is less than the desired number of objects 300 and may be equal to the desired number of objects 300 minus the first number of objects 300 counted in step 203. Continuing the above example, the predetermined second number of objects 300 may be 10 so that the 990 objects 300 in step 203 plus the 10 objects of step 205 may equal the desired number of 1000 objects 300. As objects 300 pass through the detection channels 13 and into the supplement staging channels 17, a detection unit 14 in communication with the processing unit 27 may provide information to the processing unit 27 which enables the processing unit 27 to determine the number of objects 300 that passed through the detection channels 13 into the supplement staging channels 17.

Once the predetermined second number of objects 300 passing from the detection channels 13 into one or more supplement staging channels 17 may be detected, the exit of objects 300 from the supplement staging channel(s) 17 may be stopped in step 206. In preferred embodiments, if more than one supplement staging channel 17 is in operation, then one or more, and preferably all, supplement staging channels 17 may be stopped via their respective governors 15. Each governor 15 may be in communication with the processing unit 27, and the processing unit 27 may operate the respective governor(s) 15 to stop the exit of objects 300 from the supplement staging channel(s) 17. While objects 300 may be prevented from exiting the supplement staging channel(s) 17, objects may still enter the supplement staging channel(s) 17 and the processing unit 27 may track or memorize the number of objects 300 that have entered the supplement staging channel(s) 17. After the predetermined second number of objects 300 has exited the supplement staging channel(s) 17 and preferably combined with the predetermined first number of objects 300 in a container 301, the method 200 may finish 207.

While some materials have been provided, in other embodiments, the elements that comprise the device 100 such as an object feeder 11, detection channels 13, hybrid staging channel(s) 16, supplement staging channel(s) 17, optional movable supports 19, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A hybrid counting device for counting objects, the device comprising:

an object feeder having a plurality of tray channels for receiving objects arranged in a single file line of objects, wherein each tray channel allows only the single file line of objects to exit that respective tray channel at a time;

a plurality of detection channels, wherein each tray channel is in communication with only a single detection channel so that each detection channel receives only a respective single file line of objects and wherein each detection channel is bordered by a detection wall and a the detection wall separates each of the single file line of objects;

a detection unit in communication with each detection channel;

a hybrid staging channel in communication with at least two tray channels and at least two detection channels to receive at least two single file lines of objects exiting each of their respective detection channels, wherein the exit of objects from the hybrid staging channel is controlled by a respective first governor;

a first supplement staging channel positioned laterally adjacent to the hybrid staging channel, a second supplement staging channel positioned laterally adjacent to the hybrid staging channel, the hybrid staging channel positioned in between the first supplement and staging channel and the second supplement staging channel and wherein the first supplement staging channel is in communication with only a single detection channel to receive only a single file line of objects from the single detection channel, wherein the exit of objects from the first supplement staging channel is controlled by a respective second governor;

wherein the first governor is located in between the hybrid staging channel and at least one of; a funnel and a container and the first governor governs the release of the objects after they pass through the hybrid staging channel, and wherein the second governor is located in between the first supplement staging channel and at least one of; the funnel and the container and the second governor governs the release of the objects after they pass through the first supplement staging channel, and wherein the second governor is positioned latterly adjacent to the first governor; and wherein the one of the funnel and the container receives objects form all of (i) the first supplement staging channel, (ii) the second supplement staging channel, and (iii) the hybrid staging channel.

2. The device of claim 1, wherein the number of tray channels is greater than the number of governors.

3. The device of claim 1, further comprising a processing unit in communication with the detection unit, first governor, and second governor.

4. The device of claim 3, wherein the processing unit controls the first governor to stop the exit of objects from the hybrid staging channel after a predetermined first number of objects passes into the hybrid staging channel and into the supplement staging channel.

5. The device of claim 3, wherein the processing unit controls the second governor to stop the exit of objects from the supplement staging channel after a predetermined second number of objects passes into the supplement staging channel.

6. The device of claim 3, wherein the processing unit controls the first governor to stop the exit of objects from a hybrid staging channel after a predetermined first number of objects passes into the hybrid staging channel and into the supplement staging channel and before controlling the second governor to stop the exit of objects from the supplement staging channel.

7. The device of claim 3, further comprising a motor configured to drive the object feeder, and wherein the motor is operable by the processing unit.

8. The device of claim 1, wherein the number of tray channels is equal to the number of detection channels.

9. The device of claim 1, wherein the number of detection channels is greater than the number of governors.

10. A method for counting objects, the method comprising:

a. activating an object feeder having a plurality of tray channels to communicate a single streams of objects from each tray channel of the plurality of tray channels into a respective detection channel, wherein each tray channel allows only one single stream of objects to exit that respective tray channel at a time;

b. detecting a predetermined first number of objects in the detection channels which are then passed into one of; (i) a hybrid staging channel and (ii) a first supplement staging channel wherein the hybrid staging channel receives two or more single streams of objects from two or more detection channels and the first supplement staging channel receives only one single stream of objects from a respective single detection channel and wherein the first supplement staging channel is positioned latterly adjacent to the hybrid staging channel and wherein a second supplement staging channel is positioned laterally adjacent to the hybrid staging channel, the hybrid staging channel positioned in between the first supplement staging channel and the second supplement staging channel;

c. stopping the exit of objects from the hybrid staging channel with a first governor;

d. detecting a predetermined second number of objects passing from at least one detection channel into the first supplement staging channel;

e. stopping the exit of objects from the supplement staging channel with a second governor;

wherein the first governor is located in between the hybrid staging channel and at least one of; a funnel and a container to govern the release of the objects after they pass through the hybrid staging channel, and wherein the second governor is located in between the first supplement staging channel and at least one of; the funnel and the container to govern the release of the objects after they pass through the first supplement staging channel; and wherein the one of the funnel and the container receives objects from all of (i) the first supplement staging channel, (ii) the second supplement staging channel, and (iii) the hybrid staging channel.

11. The method of claim 10, wherein the number of tray channels is equal to the number of detection channels.

12. The method of claim 10, further comprising a processing unit in communication with a detection unit, a first governor, and a second governor.

13. The method of claim 12, wherein the number of detection channels is greater than the number of governors.

14. The method of claim 12, wherein the number of tray channels is greater than the number of governors.

* * * * *